US005502927A

United States Patent [19]

Hammerton

[11] Patent Number: 5,502,927

[45] Date of Patent: Apr. 2, 1996

[54] PORTABLE, INFLATABLE TENT

[76] Inventor: Dennis R. Hammerton, 1986 Brantley Cir., Clermont, Fla. 34711

[21] Appl. No.: 315,694

[22] Filed: Sep. 30, 1994

[51] Int. Cl.[6] ..... E04H 15/20

[52] U.S. Cl. ..... 52/218; 52/2.13; 135/137; 135/124; 135/116; 135/119

[58] Field of Search ..... 52/2.18, 2.19, 52/2.25, 2.13, 2.23; 135/124, 125, 137, 148, 116, 117, 119; 441/35, 36, 37, 38, 39, 48, 49

[56] References Cited

U.S. PATENT DOCUMENTS

| | | | |
|---|---|---|---|
| 2,363,916 | 11/1944 | Waterman et al. | 135/137 X |
| 2,819,724 | 1/1958 | Barker | 52/2.18 |
| 3,629,875 | 12/1971 | Dow | 4/146 |
| 3,751,741 | 8/1973 | Hendry | 135/125 X |
| 3,759,277 | 9/1973 | Glade | 52/2 |
| 4,109,424 | 8/1978 | Block | 52/2 |
| 4,114,325 | 9/1978 | Hochstein | 52/2 |
| 4,251,959 | 2/1981 | Hsu | 52/2 |
| 4,317,315 | 3/1982 | LeBlang | 52/2 |
| 4,707,953 | 11/1987 | Anderson et al. | 52/63 |
| 4,876,829 | 10/1989 | Mattick | 52/2.18 |
| 5,007,212 | 4/1991 | Fritts et al. | 52/2.23 |
| 5,205,086 | 4/1993 | Heim | 52/2.13 |
| 5,247,768 | 9/1993 | Russo | 52/2.25 X |

FOREIGN PATENT DOCUMENTS

| | | | |
|---|---|---|---|
| 358094 | 10/1931 | United Kingdom | 52/2.18 |
| 2043737 | 10/1980 | United Kingdom | 52/2.18 |

*Primary Examiner*—Carl D. Friedman
*Assistant Examiner*—W. Glenn Edwards
*Attorney, Agent, or Firm*—Gerald E. Linden

[57] ABSTRACT

A portable, inflatable tent has a semi-cylindrical cover portion that fastens to a planar base portion. The cover portion is provided with rib air-passageways that, when inflated, support the cover portion in its semi-cylindrical configuration. Various configurations of the rib air-passageways connecting to edge air-passageways provided with air inflation valves are described. Generally, the rib air-passageways are segregated into two groups, so that the failure of a single rib air-passageway will not cause the deflation of all of the rib air-passageways. The inflation valve(s) are preferably disposed on a surface of the cover portion that will be interior the erected tent, so that the user may reinflate the tent without exiting the tent. The tent is sized and shaped so as to provide convenient, weatherproof, portable shelter for a user.

13 Claims, 7 Drawing Sheets

PORTABLE, INFLATABLE TENT

TECHNICAL FIELD OF THE INVENTION

The present invention relates to portable shelters, more particularly to tents.

BACKGROUND OF THE INVENTION

A tent is intended to provide one or more users with a shelter which is fairly easily transported to be erected at various desired locations. Traditionally, tents have required poles, lines and/or stakes, all of which add weight to the tent (making the tent more cumbersome to transport), and all of which are readily misplaced (making the tent difficult to erect). Recent improvements in tent design have sought to eliminate these cumbersome elements.

One example of a pole-less tent is found in U.S. Pat. No. 4,876,829, incorporated by reference herein, which describes an inflatable tent structure comprising a plurality of pneumatically interconnected, elongate inflatable tubes defining the perimeter of the tent structure for being inflated in unison. A valve is provided for inflating the tubes, and a plurality of wall panels are suspended from and between the tubes to define the enclosure of the tent whereby the tubes define a support structure exterior to the enclosure of the tent. The tubes define a dome-shaped structure, the tubes converging in pneumatic interconnection with each other in a single plane at the apex of the dome-shaped structure. The valve includes a manifold in which all of the tubes interconnect at the apex of the dome-shaped structure. Among the shortcomings of such a tent, as described in this patent, are the dome shape and the interconnection of all of the tubes to a single valve. For example, failure of the single valve at the apex could result in the entire tent collapsing. Further, the location of the inflating valve on the exterior of the tent does not allow the user to re-inflate a partially inflated tent without exiting the tent.

The present invention is specifically directed at a tent for accommodating one person, that is lightweight (easy to transport), durable, weatherproof, reliable, and easy to use.

The following U.S. patents are referenced by way of background information, and are incorporated by reference herein: U.S. Pat. Nos. 5,205,086; 4,707,953; 3,629,875; 4,317,315; 3,759,277; 4,251,959; and 4,114,325.

SUMMARY OF THE INVENTION

It is an object of the present invention to provide an improved tent.

It is a further object of the present invention to provide a tent that is optimized for use by one person.

It is a further object of the present invention to provide a tent that lightweight (easy to transport), durable, weatherproof, reliable, and easy to use.

According to the invention, a generally semi-cylindrical cover portion is provided atop a generally rectangular base portion.

In one embodiment, the cover portion is closed at least one end by generally quarter-circular flaps, which are separable to allow ingress into the tent. The cover portion may be closed at one end by a non-separable, semi-circular flap.

The cover portion is provided with a plurality of semi-circular, inflatable ribs, extending circumferentially at axially spaced-apart positions. Preferably, the ribs are interconnected to one another in two groups, so that there are two valves (one valve per group of ribs) for inflating the totality of the ribs. Preferably, the valves are disposed so as to be inside the erected tent.

In one embodiment of the invention, the base portion is formed as an air mattress, inflatable with a single valve by the user.

According to an aspect of the invention, the two valves for inflating the cover portion are disposed at a location interior the erected tent, near the ends of the cover portion, so as to be accessible from exterior the tent for commencing inflating the cover portion and accessible from interior the tent for completing inflating the cover portion and/or re-inflating a partially-deflated the cover portion.

According to an aspect of the invention, the cover portion is joined to the base portion with zipper type fasteners, and said zipper type fasteners are covered by flaps on (e.g., peripheral regions of) the cover portion which are secured to edges of the base portion, such as with elongated Velcro (tm), hook and loop type fasteners. In this manner, the tent will exhibit a high degree of weatherproofness. The tent, with the cover portion joined to the base portion, resembles a quonset hut.

Among the advantages of the tent of the present invention are that the tent may be re-inflated from the inside. This is important in the event that the tent begins sagging, and completely avoids the necessity of the user exiting the tent to perform the re-inflation.

Other objects, features and advantages of the invention will become apparent in light of the following description thereof.

DETAILED DESCRIPTION OF THE INVENTION

Figure 1:
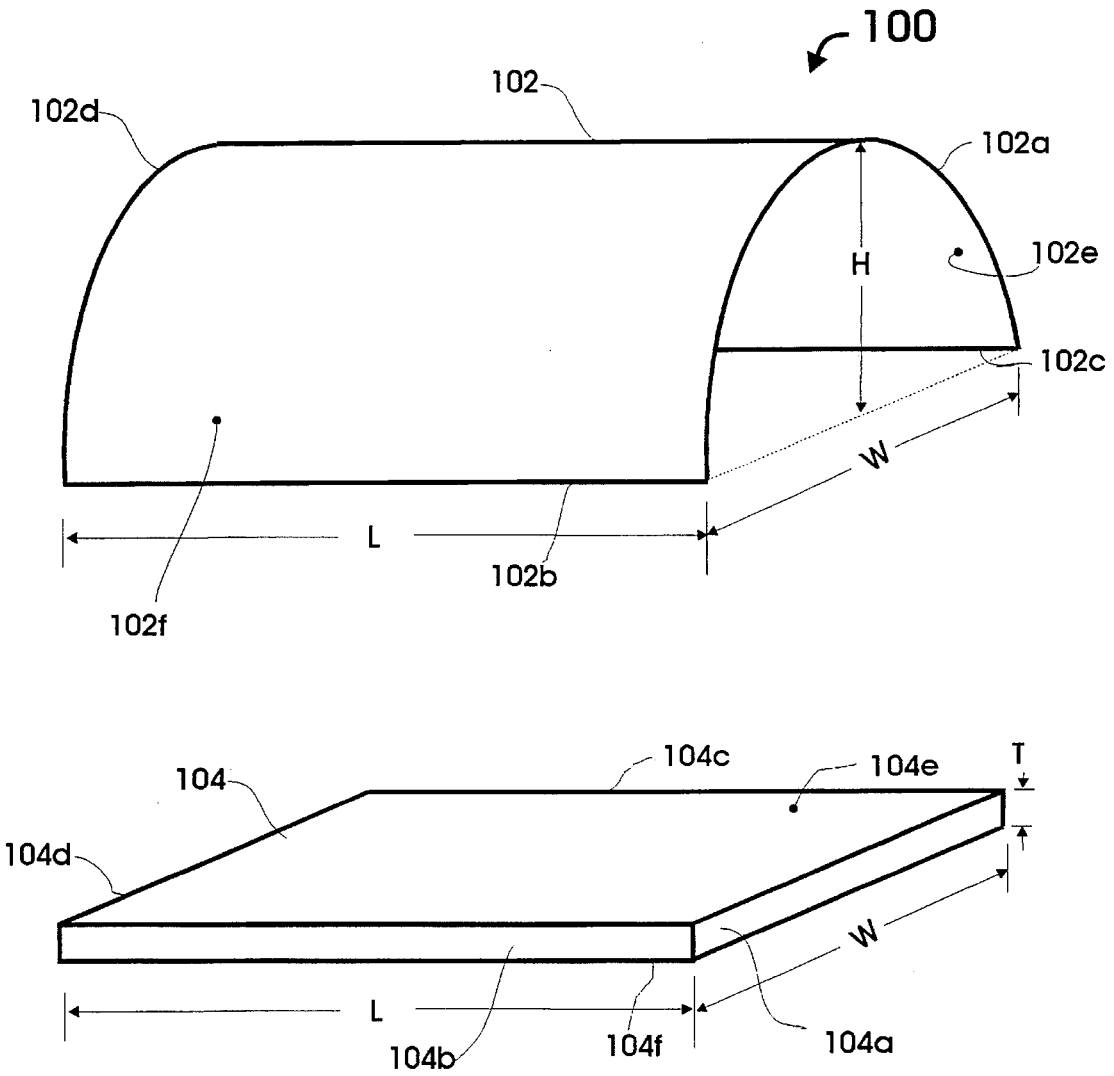
FIG. 1 is a generalized, perspective, exploded view of the tent of the present invention, showing the cover portion and the base portion. Several details of construction are omitted from this view, for illustrative clarity.

FIG. 1 illustrates, in a generalized manner, the tent 100 of the present invention. A cover portion 102 is generally semi-cylindrical, having a length "L" a width "W" and a height "H". A base portion 104 is generally rectangular, having a length "L" (approximately equal to the length of the cover portion), a width "W" (approximately equal to the width of the cover portion) and a thickness "T".

An exemplary length "L" for the cover and base portions is six-to-seven feet (72–84 inches). An exemplary width "W" for the cover and base portions is three-to-four feet (36–48 inches). An exemplary height "H" of the cover portion is three-to-four feet (36–48 inches), and an exemplary thickness "T" of the base portion is three-to-four inches. As is evident from these exemplary dimensions, the width "W" is suitably approximately equal to the height "H" and the thickness "T" is suitable approximately one tenth (e.g., one-twelfth) of the height "H".

These exemplary dimensions are suitable to provide a tent for accommodating one person, along with a modest amount of personnel effects, with head room, foot room and side room.

The cover portion 102 has a front edge 102*a*, two opposite side edges 102*b* and 102*c*, a back edge 102*d*, an inside surface 102*e* and an outside surface 102*f*.

The base portion 104 has a front edge 104*a*, two opposite side edges 104*b* and 104*c*, a back edge 104*d*, a top (inside) surface 104*e* and a bottom (outside) surface 104*f*.

As described in greater detail hereinbelow, the tent is lightweight, inflatable and waterproof.

Figure 2A:
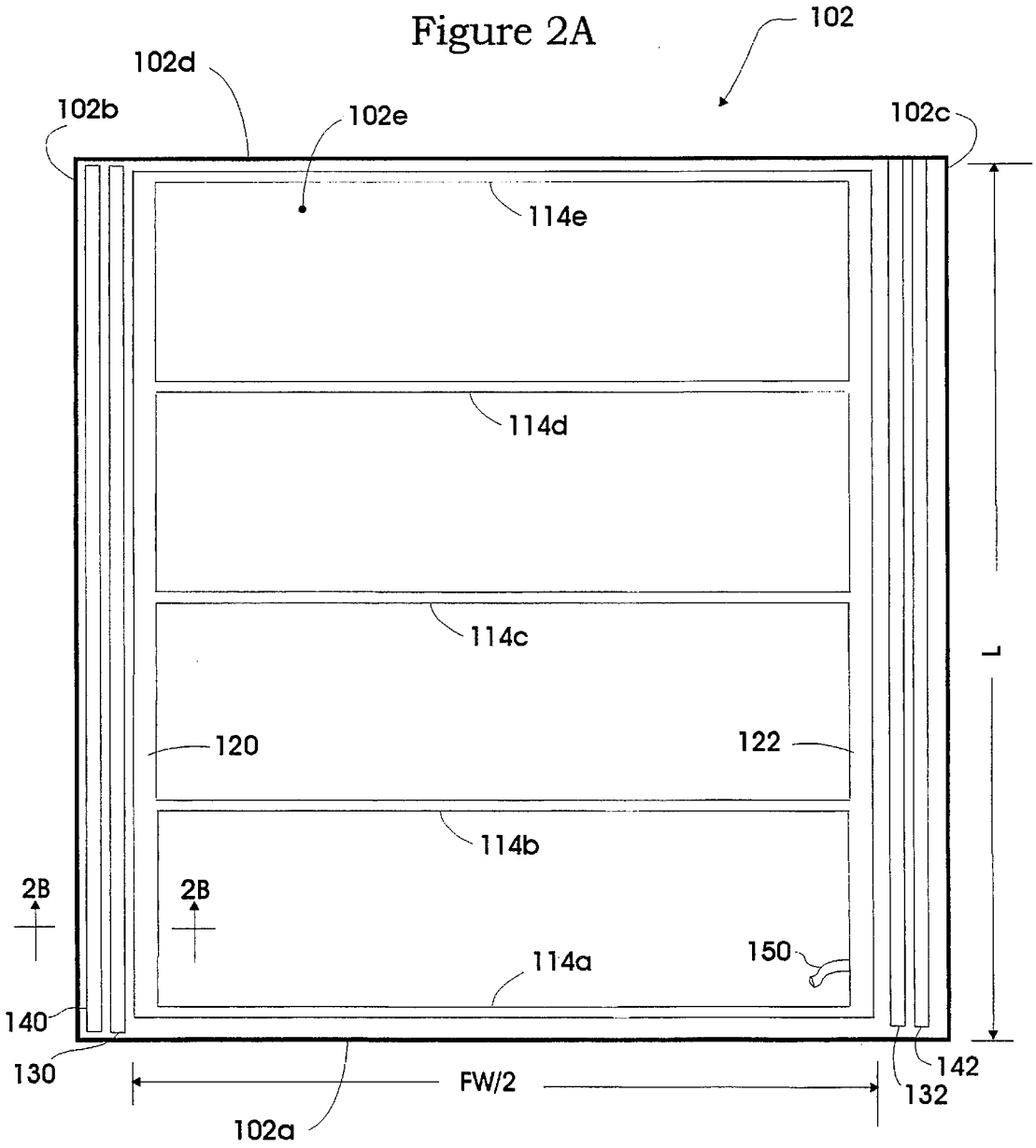
FIG. 2A is a plan view of the cover portion of the tent of the present invention.
Figure 2B:
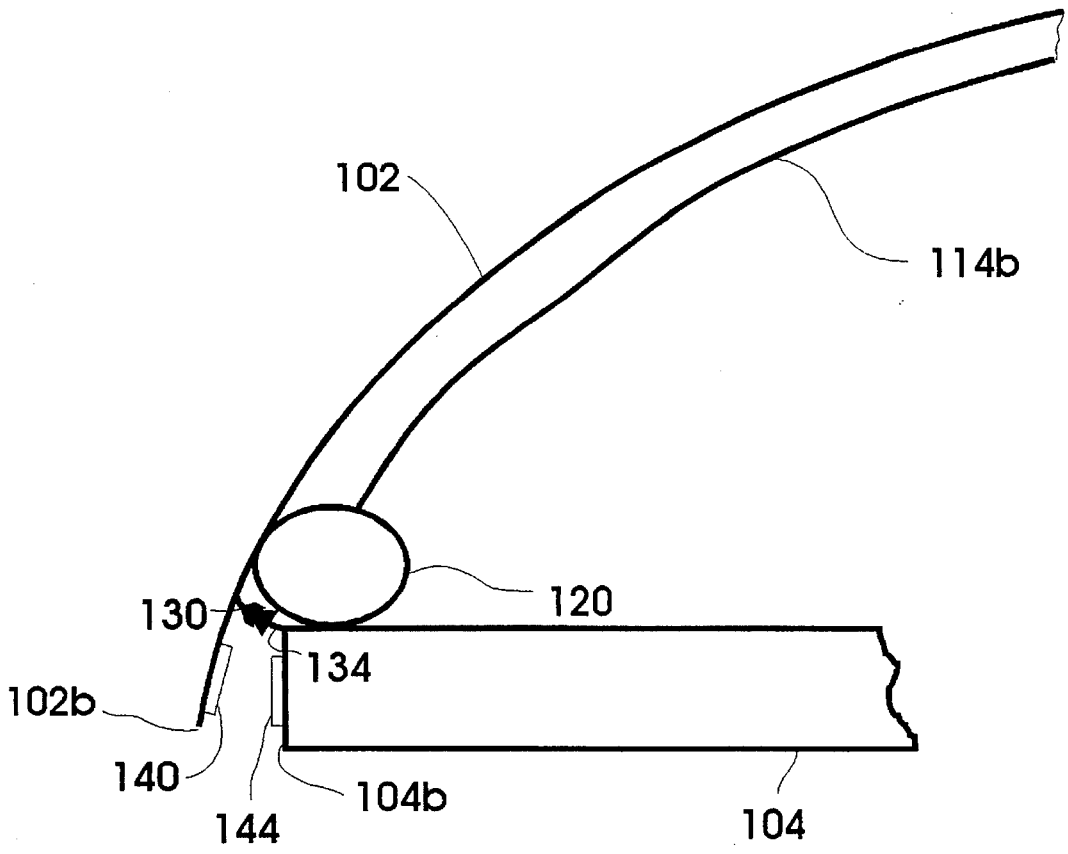
FIG. 2B is a cross-sectional view of a portion of a cover portion attaching to a portion of a base portion, of the tent of the present invention.

FIG. 2A is a flattened-out (plan) view of the cover portion 102, with the inside surface 102*e* of the cover portion 102 exposed (facing the viewer), according to a simple embodiment of the invention. The cover portion 102 is shown in a flaccid state, which it would be in prior to erecting or inflating the cover portion 102. FIG. 2B is a detail view of a side edge 102*b* of the cover portion 102 connecting to a corresponding side edge 104*b* of the base portion 104.

As best viewed in FIG. 2A, the uninflated cover portion 102 is rectangular, having two opposite side edges 102*b* and 102*c*, each side edge having a length "L". The 'flattened' width "FW" of the cover portion 102 is evidently larger than its erected width "W", for example three times its erected width, and may be approximately equal to the length "L" (i.e., FW~L). The flattened width "FW" of the cover portion is initially greater than the width "W" of the base portion (which corresponds to the erected width "W" of the cover portion).

The cover portion 102 is provided with a plurality of tubular, elongate air passageways 114*a*, 114*b*, 114*c*, 114*d*, 114*e* (five shown, may be fewer or more), extending across the width of the cover portion at longitudinally (axially) spaced-apart positions, including one passageway (114*a*, 114*e*) disposed adjacent each end of the cover portion. When inflated, these passageways (114*a* . . . 114*e*) act as "ribs" to support the cover portion in its semi-cylindrical configuration.

The cover portion 102 is provided with two tubular, elongate air passageways 120, 122, each extending inward of and parallel to a respective side edge 102*b*, 102*c* of the cover portion 102. The rib air-passageways extend across the cover portion between the two edge air-passageways (as shown, perpendicular thereto). The ends of the rib air passageways (114*a* . . . 114*e*) are connected to the edge air passageways (120, 122). In this manner, by providing air into the edge air passageways (120, 122), air is communicated into the rib air passageways (114*a* . . . 114*e*). Were the side edges 102*b*, 102*c* of the cover portion unconstrained, this would result in the various air passageways being inflated, but would not result in the cover portion being erected into a semi-cylindrical configuration. In order to achieve the semi-cylindrical configuration of the cover portion, it is necessary to constrain the side edges of the cover portion to be less than "FW" (its flattened width), namely to be equal to the width "W" of the erected tent.

The side edges 102*b*, 102*c* of the cover portion are each provided with two distinct fastening systems for connecting the cover portion 102 to the base portion 104.

A first fastening system, disposed approximately three-to-four inches within the perimeter (i.e., within a side edge) of the cover portion, and immediately outside of the respective edge air passageway (120, 122), comprises one elongate component 130, 132 of a two-component zipper-type fastener.

As best viewed in FIG. 2B, each side edge 104*b*, 104*c* (only one of the two side edges are shown in this figure) of the base portion is provided with a corresponding (mating) elongate component 134 of a zipper-type fastener. In use, prior to inflating the cover portion, the component 130 is connected to the component 134, and the component 132 is connected to a similar component (not shown) on the opposite side edge 104*c* of the base portion 104. The zipper components comprise the first fastening system, and constrain the cover portion to the width "W" so that the rib air passageways, when inflated, will cause the cover portion 102 to be erected (i.e., to be generally semi-cylindrical and to have a height "H"). The fasteners (e.g., 130/134, and 132) secure the cover portion 102 to the base portion 104.

In order to ensure that there is a weatherproof connection between the cover portion 102 and the base portion 104, a second fastening system comprises elongate strips 140, 142 of one component of a Velcro (tm), hook and loop type fastener system disposed along each side edge 102*b*, 102*c* of the cover portion, just inside the perimeter of the cover portion and outside the location of the zipper component. Another corresponding elongate component 144 (only one shown in FIG. 2B) is disposed on the side edges 104*b* (and 104*c*, not shown) of the base portion 104. In use, after the cover portion 102 is zipped to the base portion 104, the Velcro-type fasteners are brought securely together so that a peripheral region of the cover portion extends over the zippers, thereby weatherproofing the junction between the cover portion 102 and the base portion 104.

Although the cover portion 102 has been described as semi-cylindrical, it is within the scope of this invention that the cross-section of the cover section not be perfectly semi-circular, but rather it can be semi-elliptical—the general idea being that it is three-dimensional and is curved.

FIG. 2A shows an air (inflation) valve 150 suitable for inflating the rib air passageways, such as by the user blowing air into the air valve. Generally, it is preferred that this air valve 150 be disposed at a location that is interior the erected tent so that a partially-deflated tent (e.g., a sagging, previously-erected cover portion) can be re-inflated by the user without exiting the tent. In FIG. 2A, all of the rib air-passageways are connected to one another. Evidently, a hole in one rib air-passageway would cause deflation of all of the rib air-passageways. Alternate embodiments of the rib air-passageways are shown and described with respect to FIGS. 5A–5D.

Figure 3:
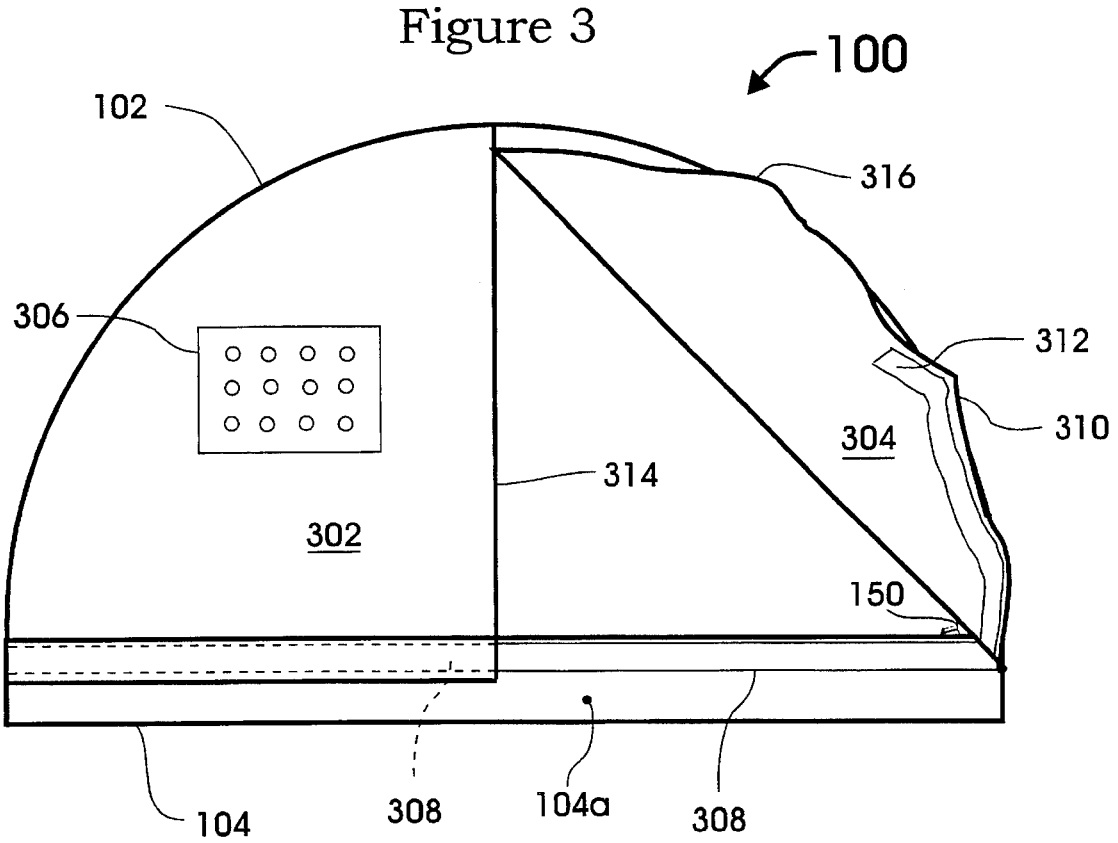
FIG. 3 is an end view of the tent of the present invention.

FIG. 3 shows a representative one end (e.g., the 'front end') of the tent 100. Preferably, both (front and back) ends of the tent are constructed in an identical manner. The front end of the tent comprises two quarter-circular flaps 302 and 304, each extending from the front edge 102*a* (see FIG. 1) of the cover portion 102. The front (and rear) flaps are advertently omitted from the illustrations of FIGS. 1 and 2A, for illustrative clarity.

Each end flap (302,304) is provided with a vented window 306. The vented window may be opaque, and may be secured only at its top edge to the respective end flap. Preferably all (four) end flaps are provided with a similar window.

As shown in FIG. 3, one end flap 302 is in a closed position, and one end flap 304 is in an open (furled) position.

The inflating valve 150 (compare FIG. 2A) is visible behind the open flap 304.

The front edge 104a of the bottom portion 104 is provided with one component 308 of a two-component, Velcro(tm)-type fastening system. The corresponding bottom edge 310 of each end flap (304) is provided with another component 312 of the two-component, Velcro(tm)-type fastening system. In this manner, when the end flaps are closed, the ends of the tent can be sealed against weather. Any suitable fastening system (such as a zipper or Velcro(tm); not shown) is provided on the side edges 314, 316 of the end flaps 302, 304, respectively, so that the two quarter-circular end flaps can be joined to form a semi-circular end panel for the tent, and separated to allow ingress into the tent.

Figure 4A:
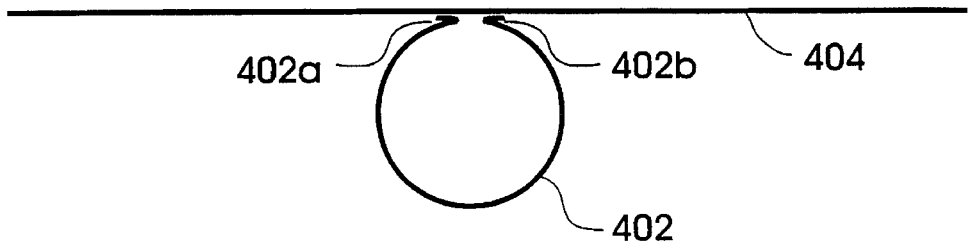
FIGS. 4A, 4B 4C are cross-sectional views of a portion of the cover portion of the tent of the present invention, detailing methods of connecting air-passageways to the cover portion.
Figure 4B:
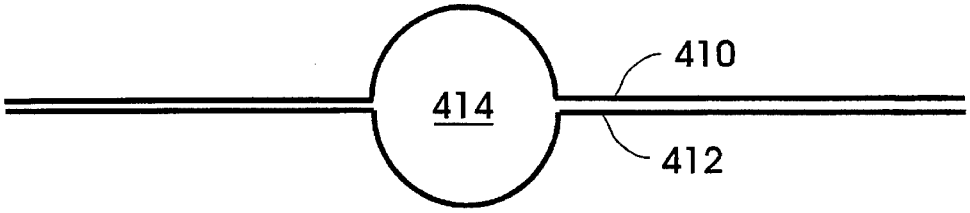
Figure 4C:
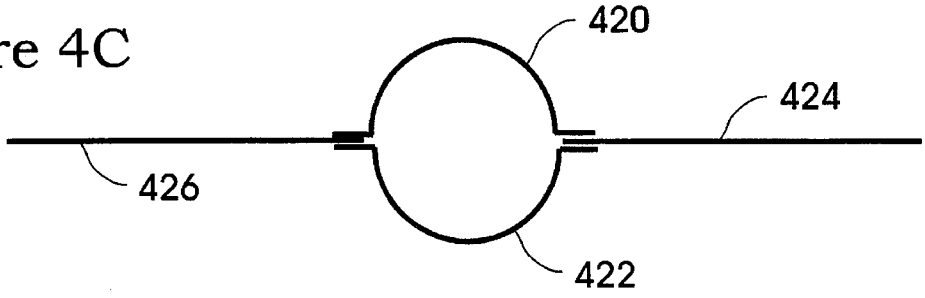

FIGS. 4A, 4B and 4C illustrate various (alternate) ways of forming the tubular air-passageways (e.g., 114*a* . . . 114*e*, 120, 122; see FIG. 2A) integrally with the cover portion (102).

In FIG. 4A, a representative tubular air passageway 402 (representing the edge and rib air-passageways) is formed as a nearly complete circle (in cross-section), the ends 402*a* and 402*b* of which are folded back (outward from the circle) and joined (with a suitable adhesive, or the like) to a representative (e.g., inner) surface 404 of the cover portion (102). This may be the inner surface 102*e* (compare FIG. 2A), or may be the outer surface (102*f*), but is preferably the inner surface.

In FIG. 4B, the cover portion is formed having a double thickness, represented by the surfaces 410 and 412. A representative air-passageway 414 is formed by a void between the two surfaces 410, 412. In areas where there is not an air-passageway (414) the two surfaces are joined (e.g., laminated) by a suitable adhesive (not shown).

In FIG. 4C, the air-passageway is formed as two semi-circular elements 420 and 422. The ends of each semi-circular element extend radially away from the semi-circular element, and are spaced apart so that ends of regions 424 and 426 or the cover portion can be sealed within these ends. This is similar to known methods of joining tubular air-passageways, as shown in FIG. 18 of U.S. Pat. No. 4,317,315.

FIGS. 5A, 5B, 5C and 5D illustrate various (alternate) ways of interconnecting the edge air-passageways (e.g., 120, 122; see FIG. 2A) with the rib air-passageways (114*a* . . . 114*e*, see FIG. 2A). It is generally preferred that the rib air-passageways are isolated from one another, and so that the failure of one rib air-passageway will not adversely affect at least a portion of the remaining rib air-passageways. In these figures, two edge air-passageways 502 and 504 are illustrated, and a plurality of (in this case, six) rib air-passageways 506, 508, 510, 512, 514 and 516 are illustrated. The cover portion 102 is shown in dashed lines, and its edges (102*a* . . . 102*d*) are indicated consistent with the illustration of FIG. 2A. As in FIG. 2A, in this figure the edge air-passageways are disposed on the cover portion, each edge air-passageway disposed on the cover portion inward of a corresponding opposite side edge of the cover portion. As will be evident, the rib air-passageways are discussed as being in two groups (two pluralities) disposed on the cover portion. Generally, both pluralities of rib air-passageways extending widthwise across the cover portion between the two edge air-passageways and are connected to the two elongate edge air-passageways. Throughout these figures, an inflation valve (see, e.g., 150, FIG. 2A) is associated with each edge air-passageway (disposed near the end of each edge air-passageway).

Figure 5A:
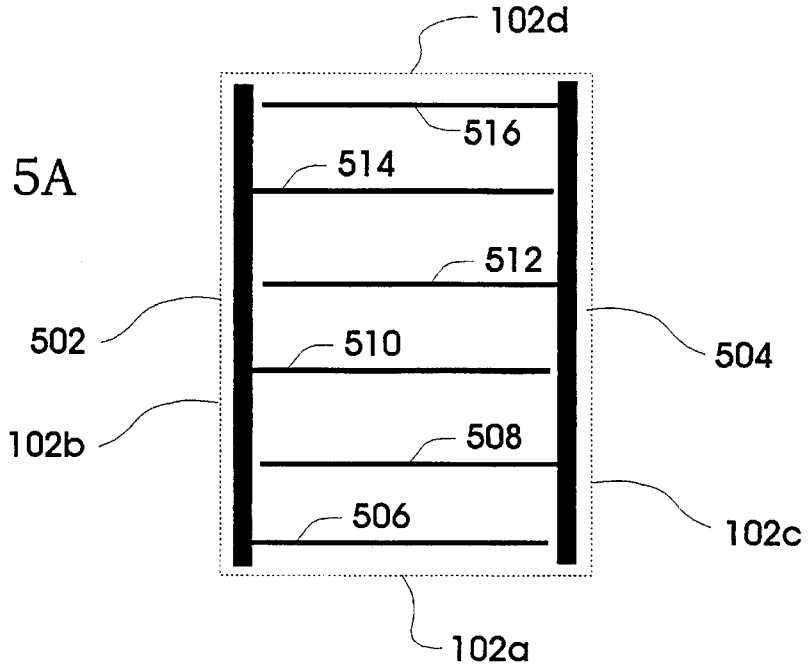
FIGS. 5A, 5B, 5C and 5D are plan views of the cover portion of the tent of the present invention, showing various embodiments for isolating rib air-passageways from one another.

As shown in FIG. 5A, the first plurality (506, 510, 514) of rib air-passageways are interleaved with the second plurality (508, 512, 516) of rib air-passageways. The first plurality (506, 510, 514) of rib air-passageways are connected solely to a one of the edge air passageways (502). The second plurality (508, 512, 516) of rib air-passageways are connected solely to an other of the edge air passageways (504). In this manner, should there be a leak in any one of the edge air-passageway 502 or the rib air-passageways (506, 510, 514) connected thereto, the other edge air-passageway 504 and the other rib air-passageways (508, 512, 516) connected thereto would not lose their structural (inflated) integrity, and vice-versa. This arrangement (of the rib air-passageways) has the advantage that if one group fails, the user would still have a semi-cylindrical (cover portion) tent enclosure, albeit a bit saggy at certain locations.

Figure 5B:
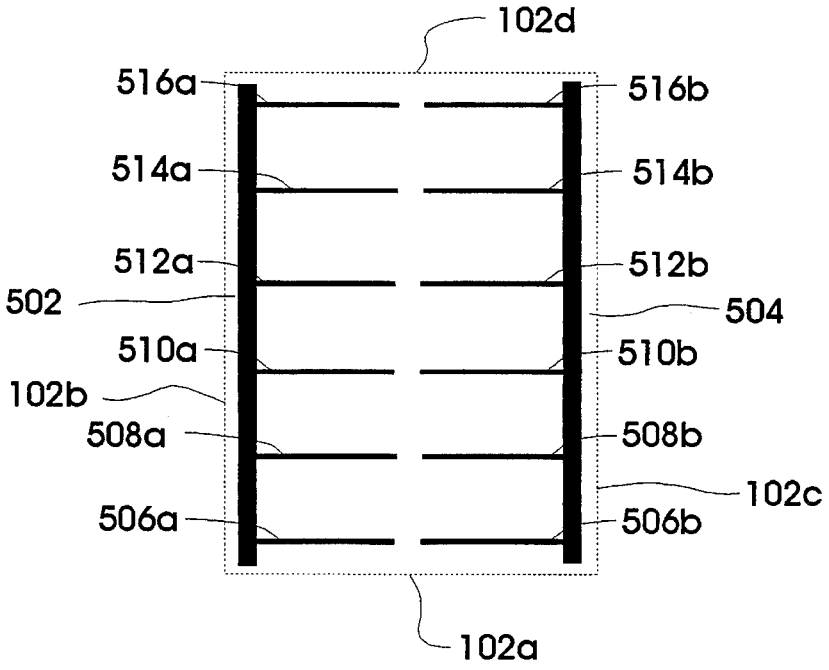

As shown in FIG. 5B, the first plurality (506*a*, 508*a*, 510*a*, 512*a*, 514*a*, 516*a*) of elongate rib air-passageways are connected to a one of the edge air-passageways 502, and are disposed in line with the second plurality (506*b*, 508*b*, 510*b*, 512*b*, 514*b*, 516*b*) of rib air-passageways which are connected to the other of the edge air-passageways 504. In this manner, one 'group' of rib air-passageways can fail without compromising the integrity of the other group of rib air-passageways. Each rib air-passageway (e.g., 506) is divided into two widthwise segments (e.g., 506*a* and 506*b*). This arrangement (of the rib air-passageways) has the advantage that if one group fails, the user is left with a quarter-cylindrical (cover portion) tent enclosure.

Figure 5C:
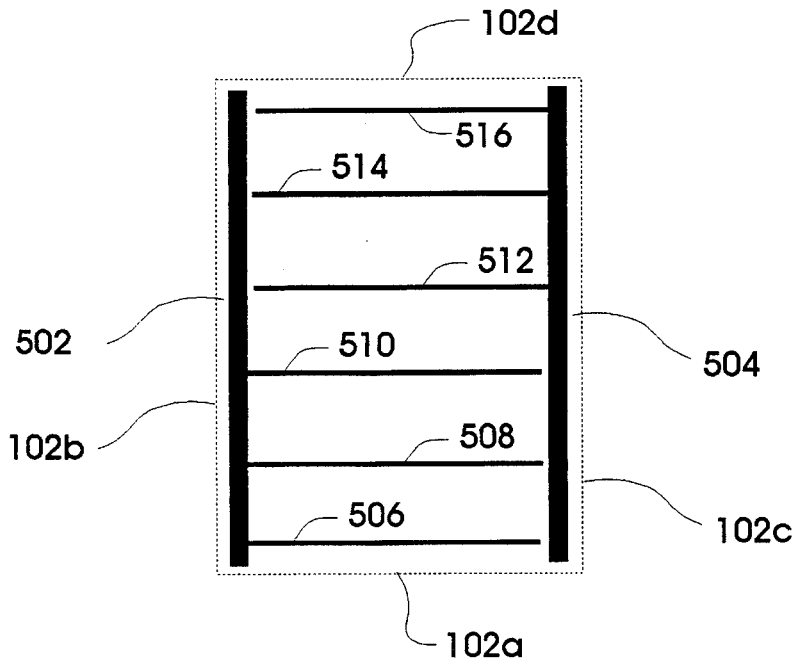

As shown in FIG. 5C, the first plurality (506, 508, 510) of rib air-passageways are in communication with a one of the edge air-passageways 502, and are arranged towards one end 102*a* of the cover portion. The second plurality (512, 514, 516) of rib air-passageways are in communication with an other edge air-passageway 504, and are arranged at another, opposite end 102*d* of the cover portion. This arrangement (of the rib air-passageways) has the advantage that if one group fails, one (or the other) one half of the length of the tent enclosure (i.e., the cover portion thereof) will remain fully supported by three (half the total number) of inflated rib air-passageways. Presumably, the user would lay down with their head at the erected (inflated) end of the tent.

Figure 5D:
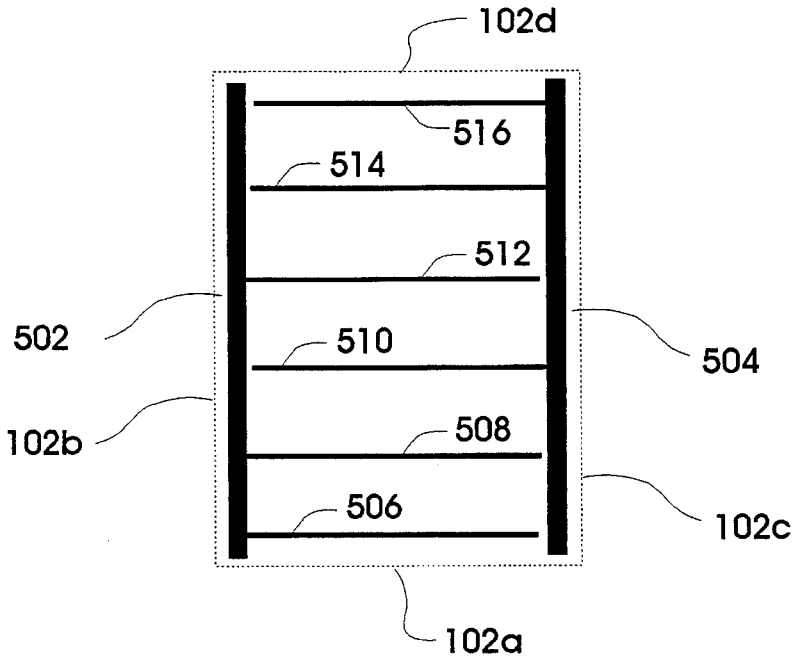

As shown FIG. 5D, the first plurality of rib air-passageways are "staggered" with the second plurality of rib air-passageways. In other words, the pattern is not strictly interleaved (e.g., one rib to the left, next rib to the right, next rib to the left, etc.), but rather is interleaved in the following manner. The first two rib air-passageways (506, 508) and the fourth rib air-passageway (512) are connected to a one of the edge air-passageways (502). The third (510) and the last two (514,516) rib air-passageways (506, 508) are connected to an other of the edge air-passageways (504). This arrangement (of the rib air-passageways), is similar to the arrangement shown in FIG. 50 in that if one group (or rib air-passageways) fails, the one end of the tent will remain erected (in this case, a third of the tent's length).

The base portion 104 (see, e.g., FIG. 1) is preferably formed as an air-mattress, having its own inflation valve. Certain salient features of the base portion 104 have been shown and discussed with respect to FIGS. 2B and 3 (e.g., zipper-type fasteners and hook-and-loop tope fasteners disposed on the side edges of the base portion).

The cover portion (102) and the base portion (104) are formed of any material suitable for such a tent, such as plastic, nylon, polyester, plasticized fabric, etc. Evidently, the material of the elongate tubes (edge and rib air-passageways) should be airtight.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected.

What is claimed is:

1. A portable, inflatable tent, comprising:

a generally rectangular base portion having a length, a width and a thickness;

a cover portion having a length corresponding to the length of the base portion, a width initially greater than the width of the base portion and corresponding to the width of the base portion when the cover portion is erected, and a height when the cover portion is erected, said cover portion being generally semi-cylindrical when erected; and means for connecting the cover portion to the base portion;

further comprising:

two elongate edge air-passageways disposed on the cover portion, each edge air-passageway disposed on the cover portion inward of a corresponding opposite side edge of the cover portion;

a first plurality of elongate rib air-passageways disposed on the cover portion, each of the first plurality of rib air-passageways extending widthwise across the cover portion between the two edge air-passageways and connected to a one of the two elongate edge air-passageways; and a second plurality of elongate rib air-passageways disposed on the cover portion, each of the second plurality of rib air-passageways extending widthwise across the cover portion between the two edge air-passageways and connected to an other of the two elongate edge air-passageways.

2. A portable, inflatable tent, according to claim 1, wherein the means for connecting the cover portion to the base portion includes:

two elongate first fastening components, each first fastening component disposed near a corresponding opposite side edge of the cover portion; and two elongate second fastening components, each second fastening component disposed at a side edge of the base portion;

each one of said first fastening components mating with a corresponding one of the two second fastening components for securing the cover portion to the base portion.

3. A portable, inflatable tent, according to claim 1, further comprising:

two inflation valves, each inflation valve associated with one of the two edge air-passageways.

4. A portable, inflatable tent according to claim 3, wherein:

the inflation valves are disposed so as to be interior the tent when the cover portion is erected.

5. A portable, inflatable tent, according to claim 1, wherein:

the base portion is formed as an air mattress.

6. A portable, inflatable tent, according to claim 1, further comprising:

two quarter-circular end flaps disposed at one end of the cover portion.

7. A portable, inflatable tent, according to claim 1, wherein:

the first plurality of rib air-passageways are interleaved with the second plurality of rib air-passageways.

8. A portable, inflatable tent, according to claim 1, wherein:

the first plurality of elongate rib air-passageways are disposed in line with the second plurality of rib air-passageways.

9. A portable, inflatable tent, according to claim 1, wherein:

the first plurality of rib air-passageways are arranged at one end of the cover portion; and the second plurality of rib air-passageways are arranged at another end of the cover portion.

10. A portable, inflatable tent, according to claim 1, wherein:

the first plurality of rib air-passageways are staggered with the second plurality of rib air-passageways.

11. A portable inflatable tent according to claim 1, wherein:

the height of the cover portion is approximately equal to the width of the cover portion.

12. A portable, inflatable tent, according to claim 1, wherein:

the thickness of the base portion is approximately one-tenth to one twelfth the height of the cover portion.

13. A portable, inflatable tent, according to claim 1, wherein:

the tent is sized to accommodate one user.

* * * * *